US009562539B2

(12) United States Patent
Hunt et al.

(10) Patent No.: US 9,562,539 B2
(45) Date of Patent: Feb. 7, 2017

(54) METHOD AND APPARATUS FOR SEALING A ROTATING MACHINE USING FLOATING SEALS

(71) Applicant: Fluid Equipment Development Company, LLC, Monroe, MI (US)

(72) Inventors: Jason B. Hunt, Monroe, MI (US); Ryan Kitzmiller, Toledo, OH (US)

(73) Assignee: FLUID EQUIPMENT DEVELOPMENT COMPANY, LLC, Monroe, MI (US)

( * ) Notice: Subject to any disclaimer, the term of this patent is extended or adjusted under 35 U.S.C. 154(b) by 541 days.

(21) Appl. No.: 14/177,611

(22) Filed: Feb. 11, 2014

(65) Prior Publication Data

US 2014/0227086 A1 Aug. 14, 2014

Related U.S. Application Data

(60) Provisional application No. 61/763,131, filed on Feb. 11, 2013.

(51) Int. Cl.
*F04D 29/08* (2006.01)
*F04D 29/16* (2006.01)

(52) U.S. Cl.
CPC ..... *F04D 29/08* (2013.01); *F04D 29/162* (2013.01); *F04D 29/167* (2013.01)

(58) Field of Classification Search
CPC ..... F04D 29/08; F04D 29/162; F04D 29/167
See application file for complete search history.

(56) References Cited

U.S. PATENT DOCUMENTS 1,715,944 A * 6/1929 Letts ..... F04D 29/167 277/558
2,270,054 A * 1/1942 Hogan ..... F04D 7/04 277/562
2,396,319 A * 3/1946 Edwards ..... F04D 5/00 277/643
2,536,292 A * 1/1951 Kollsman ..... F16L 27/082 277/399
2,604,050 A * 7/1952 Wilson ..... F04D 29/167 277/364
2,823,058 A * 2/1958 Ecker ..... F16J 15/38 277/352
3,213,798 A * 10/1965 Carswell ..... F04D 29/108 277/348
4,976,444 A * 12/1990 Richards ..... F16J 15/443 277/412
7,429,160 B2 * 9/2008 Roudnev ..... F04D 29/167 415/174.3

FOREIGN PATENT DOCUMENTS

CH 138087 A * 2/1930 ..... F01D 11/02

OTHER PUBLICATIONS

PCT Search report, May 8, 2014.*

* cited by examiner

*Primary Examiner* — Igor Kershteyn
(74) *Attorney, Agent, or Firm* — Harness, Dickey & Pierce, PLC

(57) ABSTRACT

A fluid machine has a housing and a rotating portion that rotates relative to and is at least partially disposed within the housing. The housing is coupled to a seal assembly comprising a plurality of seal channels having a plurality of seal rings. Each of the plurality of seal channels comprises a respective one of the plurality of seal rings.

13 Claims, 5 Drawing Sheets

METHOD AND APPARATUS FOR SEALING A ROTATING MACHINE USING FLOATING SEALS

CROSS-REFERENCE TO RELATED APPLICATIONS

This application claims the benefit of U.S. Provisional Application No. 61/763,131 filed on Feb. 11, 2013. The disclosure of the above application is incorporated herein by reference.

TECHNICAL FIELD

The present disclosure relates generally to pumps, and, more specifically, to sealing a rotating part of the pump such as the impeller to housing interface.

BACKGROUND

The statements in this section merely provide background information related to the present disclosure and may not constitute prior art.

Fluid machines are used in many applications for many processes. Fluid machines often include rotating parts that provide challenges in the formation of seals. Sealing between high pressure and low pressure areas is important in a rotating fluid machine to prevent leakage and promote proper functioning.

In a rotating machine such as a centrifugal pump, wear rings are used to provide a seal between a rotating part and a non-rotating part. One problem with rotating machines is that high temperatures or high pressures experienced by the machines cause the machines to change shape during operation. Conventional seals and bearings have a low tolerance for casing distortion. This manifests as poor sealing and wear characteristics. As such, the casings must be designed to withstand such distortions. In many applications such as aerospace and other applications, lighter and smaller casings are important. The smaller and lighter casings are typically less expensive than larger casings.

Further areas of applicability will become apparent from the description provided herein. It should be understood that the description and specific examples are intended for purposes of illustration only and are not intended to limit the scope of the present disclosure.

SUMMARY

This section provides a general summary of the disclosure, and is not a comprehensive disclosure of its full scope or all of its features.

The present disclosure provides an improved method for sealing a rotating portion of a fluid machine with a non-rotating portion.

In one aspect of the disclosure, a fluid machine includes a housing and a rotating portion that rotates relative to and is at least partially disposed within the housing. The housing is coupled to a seal assembly comprising a plurality of seal channels having a plurality of seal rings. Each of the plurality of seal channels comprises a respective one of the plurality of seal rings.

In another aspect of the disclosure, a method includes providing a plurality of seal rings in respective seal channels of a seal assembly, sealing a lateral edge of the seal against a surface of the rotating portion, sealing a radially extending surface of the seal ring against a respective sealing surface of the seal channel, moving the rotating portion relative to the seal assembly, and moving the seal rings within the seal channels to compensate for moving the rotating portion.

Further areas of applicability will become apparent from the description provided herein. The description and specific examples in this summary are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 2:
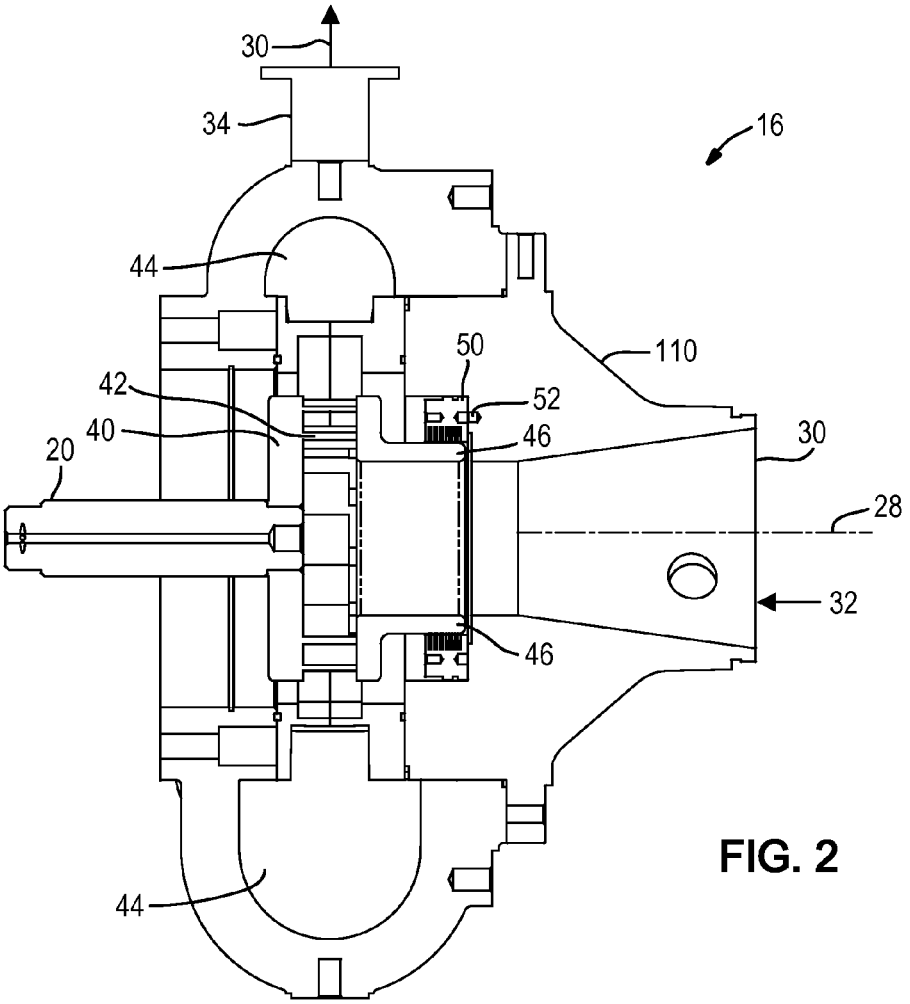
FIG. 2 is a cross-sectional view of a centrifugal pump according to the present disclosure.

The following description is merely exemplary in nature and is not intended to limit the present disclosure, application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

In the following description, a fluid machine is described as a centrifugal pump. However, there are other types of fluid machines that may benefit from the teachings set forth herein. Further, a specific attachment location and a specific number of seals are illustrated in the following disclosure. Different types of seals may be utilized in different operating conditions.

Figure 1:
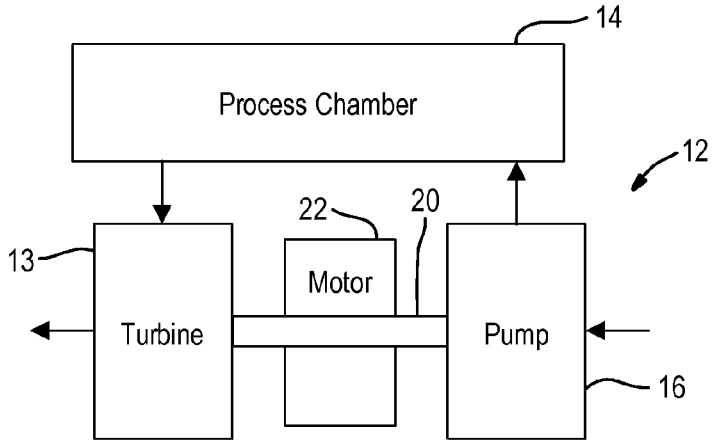
FIG. 1 is a high level block diagrammatic view of a fluid machine.

Referring now to FIG. 1, a hydraulic pressure booster (HPB) 10 is one type of fluid machine. The hydraulic pressure booster 10 is part of an overall processing system 12 that also includes a process chamber 14. Hydraulic pressure booster 10 may include a pump portion 16 and a turbine portion 18. A common shaft 20 extends between the pump portion 16 and the turbine portion 18. The HPB 10 may be free-running which means that it is solely energized by the turbine and will run at any speed where the equilibrium exists between a turbine output torque and the pump input torque. The rotor or shaft 20 may also be connected to an electric motor 22 to provide a predetermined rotational rate. The motor 22 may act as a generator and a motor.

The hydraulic pressure booster 10 is used to boost the process feed stream using energy from another process stream which is depressurized through the turbine portion 18.

Referring now to FIG. 2, a fluid machine such as the centrifugal pump 16 is illustrated. The centrifugal pump 16 has a housing 110 that may be referred to as a casing. The housing 110 has a suction nozzle or inlet nozzle 30 that receives fluid in the direction illustrated by the arrow 32. The housing 110 has a discharge nozzle 34 that discharges fluid from the casing at a high pressure in the direction illustrated by the arrow 36. Fluid entering the inlet nozzle 30 is at a relatively low pressure compared to that of the discharge nozzle 34.

An impeller 40 rotates on shaft 20. The shaft 20 is in alignment with the longitudinal axis 28 of the pump 16. The longitudinal axis 28 as illustrated as the center of the inlet nozzle 30.

The impeller 40 has vanes 42 that when rotated cause high pressure within the volute region 44 of the housing 110. It should be noted that the impeller may be referred to as a rotating portion of the fluid machine because it rotates relative to the housing 110. The casing or housing 110 may be referred to as a stationary portion of the centrifugal pump 16.

The impeller 40 may also include an axially extending flange 46. The flange 46 is coupled to the impeller 40 and rotates with the impeller. The flange 46 may be made out of the same material and integrally formed or molded with the vanes 42 and the rest of the impeller 40.

A seal assembly 50 is coupled to the housing 110 using fasteners 52. The seal assembly 50 separates the low pressure input side of the centrifugal pump 16 with the higher pressures generated within the housing 110 by the rotating impeller 40. The seal assembly 50 prevents fluid from within the high pressure portion of the housing 110 from leaking into the lower pressure input nozzle 30.

Figure 3:
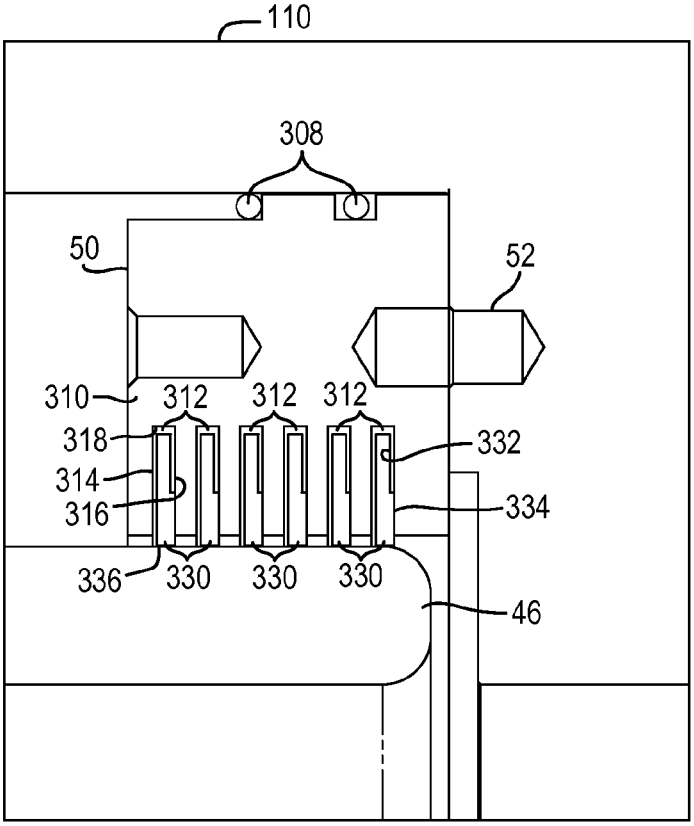
FIG. 3 is a cross-sectional view of the impeller and bearing carrier when the impeller is in an ordinary position.

Referring now to FIG. 3, an enlarged cross-sectional view of the sealing assembly 50 relative to a portion of the housing 110 is illustrated. It should be noted that seals 308 may be used to help seal the seal assembly 50 within the housing 110. As is illustrated, the left side of the seal assembly 50 is the high pressure side and to the right is the low pressure side of the seal assembly 50.

The seal assembly 50 includes a seal housing 310 that has a plurality of seals channels 312 disposed therein. The seal channels 312 extend in an axial direction. In this example, the seal channels 312 are rectangular in cross-sectional shape. However, the seal channels 312 run circumferentially within the seal housing 310.

The seal channels 312 have different surfaces including a first surface 314 that is referred to as a high pressure surface since the entire first surface 314 is exposed to high pressure. The first surface 314 extends in a radial direction outward from the flange 46. The seal channel 312 includes a second surface referred to as a sealing surface 316 parallel to the first surface. The sealing surface 316 is partially exposed to high pressure that preferably forms a seal as will be described further below. An intermediate surface 318 extending in a lateral or axial direction is used to join the first surface 314 and the sealing surface 316. The intermediate surface 318 is annular in shape and is also exposed to high pressure.

As is illustrated, six seal channels 312 are illustrated. However, those skilled in the art will recognize that various numbers of seal channels 312 may be used. The number of seal channels 312 used may depend upon the specific application including temperatures and pressures of the fluids and the conditions to which the fluid machine is subjected. The pressure differential between the inlet nozzle 30 and the outlet 34 of FIG. 2 may also be a factor.

Each seal channel 312 may include a seal ring 330. The seal ring 330 is rings disposed within each of the seal channels 312. The seal rings 330 may be composed of various materials including but not limited to plastic, graphite filled plastic, glass filled Noryl®, brass and Teflon®.

Figure 4:
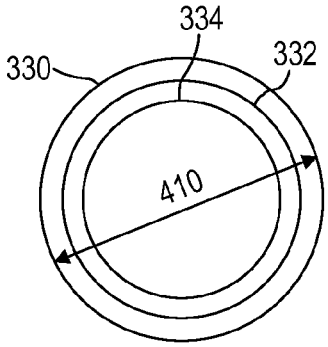
FIG. 4 is a front view of a seal ring according to the present disclosure.

Referring now FIGS. 3 and 4, a front view of the seal ring 330 is illustrated. A notch portion 332 is used to reduce the amount of surface area of the seal ring 330 contacting the sealing surface 316 as seal ring surface 334. The contact between the sealing surface 316 of the seal channel 312 and the seal ring surface 334 forms one seal. A front view of the notch 332 is best illustrated in FIG. 4. In the present example, the notch 332 may extend completely around the circumference of the seal ring 330. However, a discontinuous notched area may also be used.

Another seal is formed between an edge or a lateral surface 336 of the seal ring 330 and the impeller 40. In this example the flange 46 of the impeller 40 contacts the lateral edge surface 336. The lateral edge surface 336 extends in an axial direction.

It should be noted that the seal ring 330 has a diameter 410 that is less than an outside diameter of the surface 318 of the seal channels 312. This allows the seal rings 330 to move or have some play in a radial direction within the seal channels 312 to allow each seal ring 330 to move independently to prevent leakage based upon various alignments of the impeller 40 within the housing 110.

Figure 5:
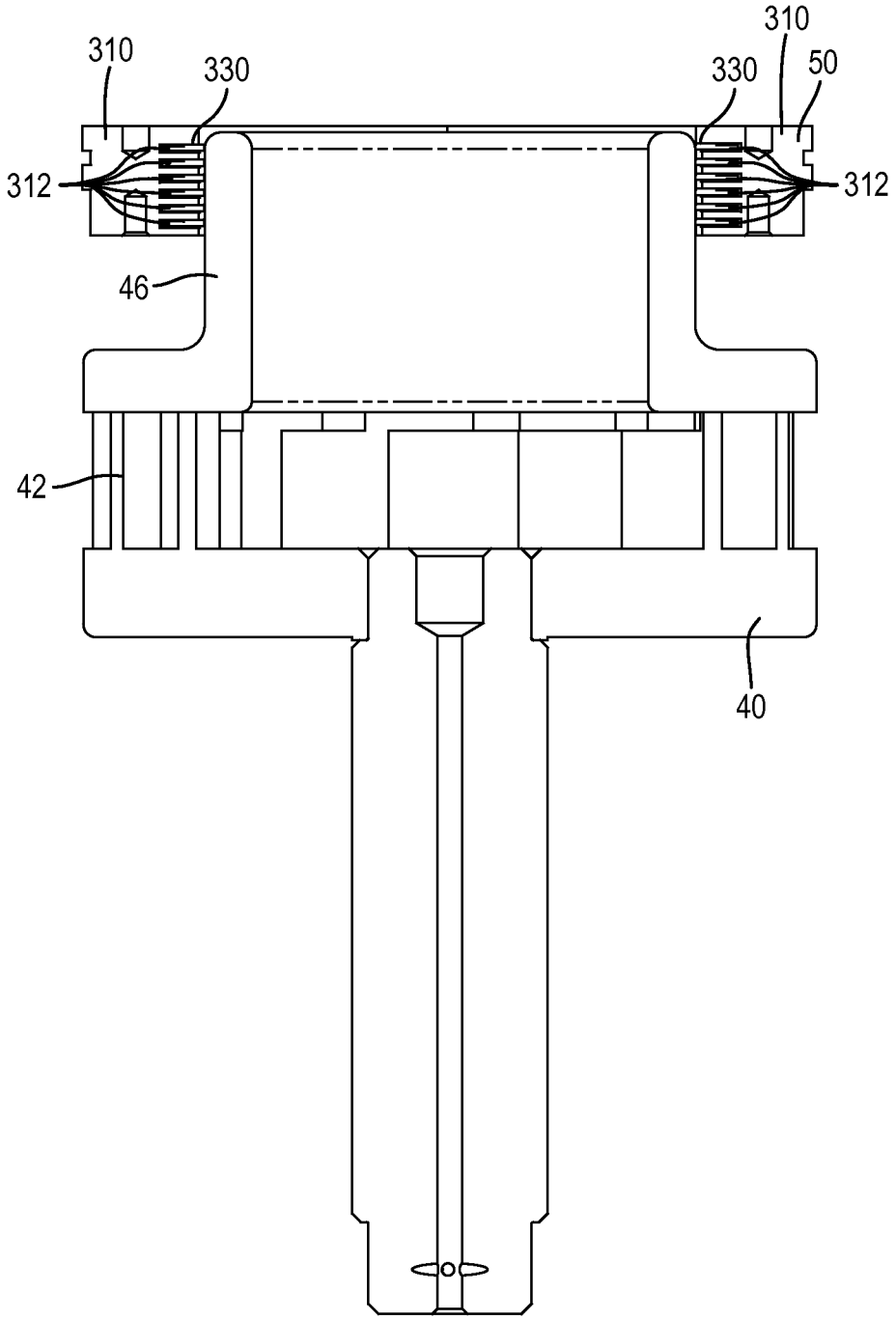
FIG. 5 is a cross-sectional view of the impeller in sealing assembly in a normal operating position.

Referring now to FIG. 5, the impeller 40 is illustrated in a simplified cross-sectional view relative to the seal assembly 50. In this view, the seal rings 330 are illustrated in a "normal" operating position so that each seal ring 330 is about centered within the respective seal channel 312.

Figure 6:
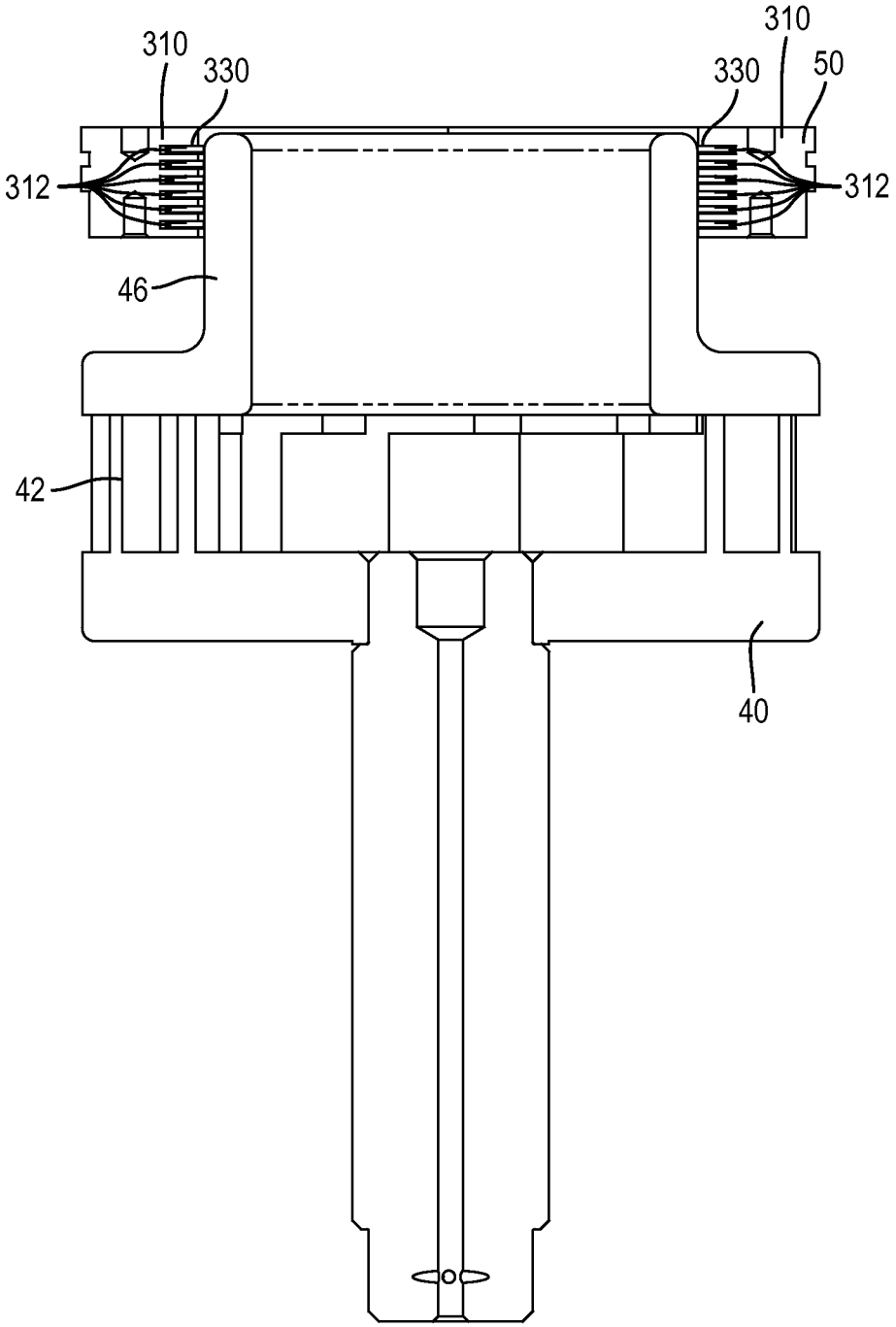
FIG. 6 is a cross-sectional view of an impeller and sealing assembly in a radially offset position.

Referring now to FIG. 6, the impeller 40 is illustrated in an axially shifted position. In this figure, the seal rings 330 are biased toward the rightmost position. The seal rings 330 have a large gap between the surface 318 on the left side of the figure and no gap between the surface 318 on the right side of the diagram. The seal rings 330 are extended a maximum distance outward from the seal channels 312 on the left side of the figure.

Figure 7:
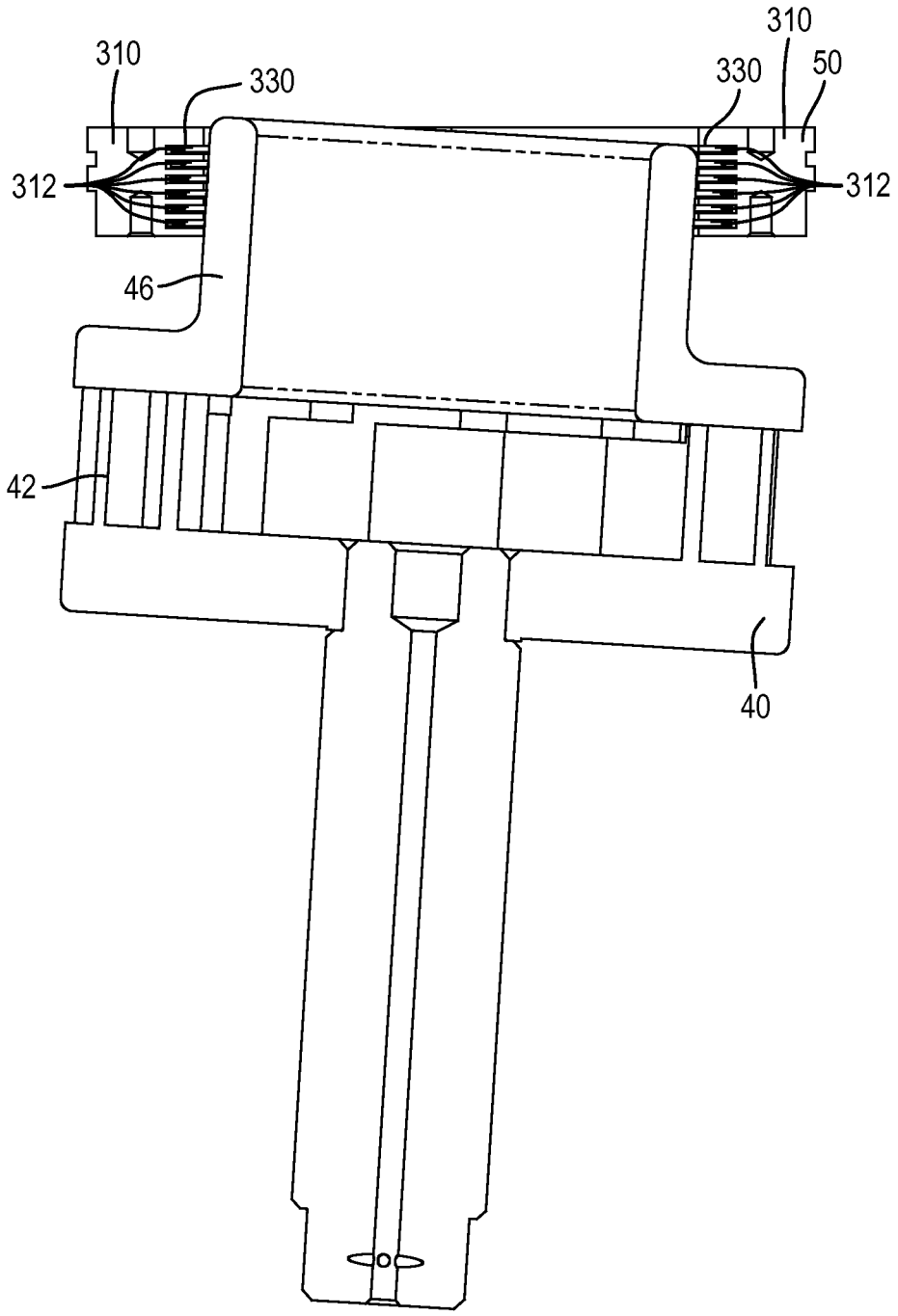
FIG. 7 is a cross-sectional view of an impeller and sealing assembly in an angular offset position.

Referring now to FIG. 7, because the seal rings 330 is independently movable, angular misalignment of the impeller 40 may be compensated for by the same rings 330. In this figure, the seal rings 330 extend a different amount from the seal channels 312. The topmost seal rings 330 on the left side of the figure extend a maximum distance while the seal rings 330 near the bottom are inset a maximum distance. On the right side of the diagram, the seals toward the axially outward position or top of the figure are slightly extended to compensate for the shape of the flange 46. The lowermost or innermost seal ring 330 extends a maximum distance from the seal assembly.

In operation, the different differentials in pressure and the thermal characteristics of the housing may cause the impeller 40 to be positioned in various ways including axial misalignment or angular misalignment. Various intermediate positions are also possible. As the impeller 40 moves in the various directions, the seal rings 330 move radially to compensate for the position of the flange 46 of the impeller 40. Multiple seal rings 330 are provided so that compensation in the angular direction may be achieved. The lateral edge surface 336 forms a seal against the impeller flange 46.

Further, sealing is achieved between the seal ring surface 334 and the sealing surface 316 of the channel 312. Different amounts of the seal ring surface 334 may contact the sealing surface 316 depending on how far the seal ring 330 has extended from the seal channel 312.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification and the following claims.

What is claimed is:

1. A fluid machine comprising:

a housing; and a rotating portion rotating at least partially disposed within the housing;

said housing coupled to a seal assembly comprising a plurality of seal channels and a plurality of seal rings, each of the plurality of seal channels comprising a respective one of the plurality of seal rings and a sealing surface, said seal rings comprising a lateral surface sealing against the rotating portion to form a first seal and a seal ring surface contacting the sealing surface to form a second seal.

2. The fluid machine as recited in claim 1 wherein the plurality of rings comprise a first seal ring surface contacting the rotating portion.

3. The fluid machine as recited in claim 2 wherein the first seal ring surface extends in a lateral direction.

4. The fluid machine as recited in claim 2 wherein the first seal ring surface engages the rotating portion.

5. The fluid machine as recited in claim 4 wherein the rotating portion comprises an impeller.

6. The fluid machine as recited in claim 4 wherein the rotating portion comprises an impeller of a centrifugal pump and the housing comprises a housing of a centrifugal pump.

7. The fluid machine as recited in claim 4 wherein the plurality of seal rings comprise a second seal ring surface.

8. The fluid machine as recited in claim 7 wherein the second seal ring surface is disposed in a radially extending direction.

9. The fluid machine as recited in claim 7 wherein the second seal ring surface has a notch disposed therein.

10. The fluid machine as recited in claim 1 wherein the rotating portion comprises a flange and wherein the plurality of seal rings contact an impeller of a centrifugal pump.

11. The fluid machine as recited in claim 1 wherein the plurality of seal rings are composed of one of plastic, graphite filled plastic, glass filled Noryl®, brass and Teflon®.

12. A method of sealing a rotating portion of a fluid machine to a housing;

providing a plurality of seal rings in respective seal channels of a seal assembly;

sealing a lateral edge of the seal against a surface of the rotating portion to form a first seal;

sealing a radially extending surface of the seal ring against a respective sealing surface of the seal channel to form a second seal;

moving the rotating portion relative to the seal assembly; and moving the seal rings independently within the seal channels to compensate for moving the rotating portion to prevent leakage based upon various alignments of the rotating portion.

13. The method of claim 12 further comprising providing the sealing ring with a notch on a sealing surface.

* * * * *